US009962574B2

(12) United States Patent
Sperry et al.

(10) Patent No.: US 9,962,574 B2
(45) Date of Patent: May 8, 2018

(54) EXERCISE APPARATUS

(75) Inventors: Laurence B. Sperry, Newton, MA (US); Brian A. Murch, Needham, MA (US); Eric A. Kane, Lynn, MA (US)

(73) Assignee: Sperry Product Innovation, Inc., Woburn, MA (US)

( * ) Notice: Subject to any disclaimer, the term of this patent is extended or adjusted under 35 U.S.C. 154(b) by 457 days.

(21) Appl. No.: 13/104,576

(22) Filed: May 10, 2011

(65) Prior Publication Data

US 2012/0289378 A1 Nov. 15, 2012

(51) Int. Cl.

| | |
|---|---|
| ***A63B 71/00*** | (2006.01) |
| ***A63B 23/08*** | (2006.01) |
| ***A63B 23/10*** | (2006.01) |
| ***A63B 22/16*** | (2006.01) |
| ***A63B 22/18*** | (2006.01) |
| ***A63B 22/20*** | (2006.01) |
| ***A63B 23/04*** | (2006.01) |

(Continued)

(52) U.S. Cl.

CPC ..... *A63B 22/16* (2013.01); *A63B 22/18* (2013.01); *A63B 22/20* (2013.01); *A63B 23/04* (2013.01); *A63B 21/4033* (2015.10); *A63B 2022/0038* (2013.01); *A63B 2022/185* (2013.01); *A63B 2208/0228* (2013.01); *A63B 2220/40* (2013.01); *A63B 2220/80* (2013.01); *A63B 2220/833* (2013.01)

(58) Field of Classification Search

USPC ..... 482/79, 80, 146, 147, 75, 76, 1, 8

See application file for complete search history.

(56) References Cited

U.S. PATENT DOCUMENTS 1,266,492 A * 5/1918 Kurrel et al. ..... A43B 5/18 36/116
2,096,500 A 10/1937 McCahan et al.
2,720,396 A 10/1955 Pfaus (Continued)

FOREIGN PATENT DOCUMENTS

WO WO 2009/141710 A2 11/2009
WO WO 2010/139015 A1 12/2010
WO WO 2010139015 A1 * 12/2010 ..... A63B 22/20

OTHER PUBLICATIONS

International Searching Authority, Invitation to Pay Additional Fees and, Where Applicable, Protest Fee for International Application No. PCT/US2010/036244, dated Sep. 28, 2012, 6 pages, European Patent Office, The Netherlands.

(Continued)

*Primary Examiner* — Andrew S Lo
*Assistant Examiner* — Shila Jalalzadeh Abyane
(74) *Attorney, Agent, or Firm* — Alston & Bird LLP

(57) ABSTRACT

Various embodiments of the present invention are directed to a sliding exercise apparatus. In various embodiments, the sliding exercise apparatus includes a sliding unit with a platform, a sliding surface, a motion sensor, and a transmitter. The sliding unit moves in response to pressure applied against the platform, as the sliding surface is adapted to slide along a ground surface in one or more directions. The motion sensor generates activity data based on one or more characteristics of the movement, such as speed, direction, etc. The transmitter sends the activity data to a computing device, which is adapted for processing, storing, and sharing information based on the activity data.

34 Claims, 9 Drawing Sheets

(51) Int. Cl.
*A63B 22/00* (2006.01)
*A63B 21/00* (2006.01)

(56) References Cited

U.S. PATENT DOCUMENTS 3,188,087 A * 6/1965 Larson, Jr. ..... A63B 21/0004 273/115
3,219,358 A * 11/1965 Hagner ..... A43B 13/184 280/11.14
3,471,144 A * 10/1969 Lemaire ..... A63B 22/16 482/132
3,672,670 A 6/1972 Burzenski
4,273,327 A * 6/1981 Nall et al. ..... 482/71
D264,987 S * 6/1982 Wise ..... D21/688
4,448,411 A * 5/1984 Parker ..... A63G 11/00 482/146
4,776,583 A 10/1988 Jennings
4,892,305 A * 1/1990 Lynch ..... A63B 22/20 482/132
4,946,162 A 8/1990 Lubie
4,951,938 A * 8/1990 Smith, IV ..... A63B 21/0004 482/80
5,127,892 A 7/1992 Sawdon
5,135,450 A * 8/1992 Smith, IV ..... A63B 22/16 36/110
5,246,411 A 9/1993 Rackman et al.
5,260,870 A * 11/1993 Tsuchiya et al. ..... 600/595
5,496,248 A * 3/1996 Batscher ..... A63B 21/0004 482/146
5,632,707 A * 5/1997 Daniel ..... A63B 22/20 482/117
5,690,594 A 11/1997 Mankovitz
5,813,947 A 9/1998 Densmore
5,879,275 A * 3/1999 Aruin ..... A63B 22/14 482/146
6,019,712 A * 2/2000 Duncan ..... 482/110
6,162,189 A * 12/2000 Girone ..... A61B 5/1036 482/79
6,238,325 B1 * 5/2001 Oxford ..... 482/146
6,306,068 B1 * 10/2001 Heatwole ..... A63B 21/0004 482/146
6,447,429 B1 * 9/2002 Chen ..... A63B 21/0004 482/79
6,543,769 B1 * 4/2003 Podoloff ..... A63B 21/0004 273/148 B
6,551,225 B1 * 4/2003 Romero ..... A63B 21/0004 482/145
6,702,726 B2 * 3/2004 Lin ..... 482/148
6,852,068 B2 2/2005 Ogawa
6,866,618 B2 3/2005 Rusinak-Connors
6,942,605 B1 * 9/2005 Sukhovitsky ..... A63B 21/0004 2/24
6,945,919 B2 * 9/2005 Yang ..... 482/142
D517,136 S * 3/2006 Chen ..... D21/688
7,137,938 B2 * 11/2006 Gottlieb ..... A63B 21/0004 482/146
7,278,227 B2 * 10/2007 Masoodifar ..... A43B 13/145 36/103
7,322,904 B2 1/2008 Takizawa et al.
7,481,739 B2 1/2009 Takizawa et al.
7,641,591 B2 1/2010 Takizawa et al.
7,648,447 B2 1/2010 Andre
7,753,831 B2 * 7/2010 Langer et al. ..... 482/146
7,946,970 B2 * 5/2011 Garza, Jr. ..... A63B 21/4043 206/315.1
8,038,583 B2 * 10/2011 Bailar ..... A63B 22/16 482/105
8,272,146 B1 * 9/2012 Jackson, II ..... A43B 3/0078 36/15
D668,765 S * 10/2012 Sinett ..... D24/171
8,480,547 B2 * 7/2013 Coates ..... A63B 21/00047 482/131
8,574,138 B2 * 11/2013 Geotsalitis ..... A63B 26/003 297/423.12
2001/0036885 A1 11/2001 Castellot, Jr. et al.
2002/0026730 A1 * 3/2002 Whatley ..... 36/132
2002/0148138 A1 * 10/2002 Egan ..... 36/7.1 R
2003/0148865 A1 * 8/2003 Handshoe ..... A63B 22/18 482/148
2004/0110604 A1 * 6/2004 Chen Wu ..... A63B 22/16 482/79
2005/0054492 A1 3/2005 Neff
2005/0184878 A1 * 8/2005 Grold et al. ..... 340/573.7
2005/0245372 A1 * 11/2005 Mylrea ..... A63B 21/0004 482/148
2006/0020174 A1 * 1/2006 Matsumura ..... A61B 5/1118 600/300
2006/0116246 A1 * 6/2006 Hankin ..... A61H 1/003 482/51
2007/0037672 A1 2/2007 Nakanishi
2007/0265139 A1 11/2007 Glick
2007/0298949 A1 * 12/2007 Soletski ..... A61H 1/0266 482/146
2008/0030330 A1 * 2/2008 Vock et al. ..... 340/568.1
2008/0070752 A1 3/2008 Einav
2009/0137369 A1 * 5/2009 Branch et al. ..... 482/112
2010/0050471 A1 * 3/2010 Kim ..... 36/29
2010/0075813 A1 3/2010 Ochi et al.
2010/0105526 A1 * 4/2010 Hautoplund ..... A63B 69/0053 482/8
2010/0126902 A1 * 5/2010 Garza, Jr. ..... A63B 21/4043 206/579
2010/0222180 A1 * 9/2010 Takizawa ..... A61H 1/024 482/8
2010/0317496 A1 * 12/2010 Abranchess ..... A63B 21/0004 482/141
2011/0034301 A1 * 2/2011 Barre ..... A63B 24/00 482/4
2011/0105277 A1 * 5/2011 Shauli ..... A47C 9/002 482/4
2012/0077653 A1 * 3/2012 Dedov ..... A47C 9/002 482/139
2013/0252791 A1 * 9/2013 Chang ..... A63B 22/20 482/132

OTHER PUBLICATIONS

International Searching Authority, International Search Report and Written Opinion for International Application No. PCT/US2012/036244, dated Jan. 28, 2013, 18 pages, European Patent Office, The Netherlands.

Van Hees, et al., "Novel Daily Energy Expenditure Estimation by Using Objective Activity Type Classification: Where Do We Go From Here?" *Journal of Applied Physiology*, Sep. 2009, pp. 639-640, vol. 107.

Staudenmayer, et al., "An Artificial Neural Network to Estimate Physical Activity Energy Expenditure and Identify Physical Activity Type from Accelerometer," *Journal of Applied Physiology*, Oct. 2009, pp. 1300-1307, vol. 107.

"About Fitbit Premium," www.fitbit.com/premium/about, downloaded May 24, 2011.

European Patent Office, Communication pursuant to Article 94(3) EPC for Application No. 12720384.2, dated Feb. 2, 2017, 6 pages, Germany.

* cited by examiner

EXERCISE APPARATUS

BACKGROUND OF THE INVENTION

Sedentary lifestyles have become increasingly prevalent in office and home environments due to the widespread use of computers and other electronic devices. In many workplaces, office employees are seated at their desks in front of their computers for a large part of the workday. Such prolonged sitting, combined with long work hours, leaves little time in a work day for regular exercise. Health risks associated with sedentary lifestyles include weight gain, muscle loss, poor cardiovascular health, and higher risks of obesity. However, these risks can be counteracted with light, regular physical activity. Furthermore, even light exercise, when undertaken regularly, can have additional positive health effects, including promoting blood circulation, and stabilizing hormone levels.

Certain devices suited for exercise in the office or at a work desk exist in the art. However, these devices have a number of drawbacks, including being too bulky or too distracting from workplace tasks. Furthermore, as with many exercise devices, use diminishes over time due to factors such as inconvenience or disinterest. Accordingly, there is a need in the art for a fitness apparatus that is not only easy to use but also capable of monitoring and/or promoting exercise in an office environment.

BRIEF SUMMARY OF THE INVENTION

These and other needs are met by an exercise apparatus that comprises one or more sliding units for facilitating and sensing a movement applied thereto by the user, characterized in that at least one of the sliding units comprises a body member and a surface adapted for sliding movement in at least one direction; a sensor adapted for sensing and generating data representative of one or more characteristics of the movement; and a transmitter adapted for receiving the data from the sensor and transmitting the data to a computing device.

The exercise apparatus may comprise a first sliding unit and a second sliding unit, wherein the first sliding unit is adapted for a left foot and the second sliding unit is adapted for a right foot. The sensor may be an accelerometer, and according to an embodiment of the invention, the accelerometer is a three-axis accelerometer. The transmitter may be a wireless transmitter.

According to various embodiments of the invention, the exercise apparatus may further comprise a display, a speaker, and/or an indicator adapted to provide feedback to the user.

According to an embodiment of the invention, the body member further comprises a platform adapted to removably receive a shoe. The platform may have a front end adapted to receive a sole and a back end adapted to receive a flat heel. According to other embodiments of the invention, the platform has a front end adapted to receive a sole and a back end adapted to accommodate an elevated heel. The platform may comprise a set of gripping members capable of providing traction against the shoe.

The needs described above are also met by a method of promoting exercise by a user that comprises recording the movement of one or more sliding units moved by the user comprising the steps of sensing a movement of at least one of the sliding units; generating activity data representative of the characteristics of the movement of the sliding unit; and transmitting the data to a computing device. The method may comprise providing feedback to the user based at least in part on the transmitted data, and according to an embodiment of the invention, the feedback is in the form of an audible indicator.

The method may further comprise providing an activity analysis, which may be based on one or more physical characteristics of the user, including, for example, body weight. The method may further comprise sending the activity data to a social networking server.

The needs described above are further met by a system for promoting exercise that comprises one or more sliding units for facilitating and sensing movement applied thereto by the user. The sliding units may each comprise a body member and a surface adapted for sliding movement in at least one direction; a sensor adapted for sensing movement and generating activity data representative of one or more characteristics of the movement of the sliding unit; a transmitter adapted for receiving and sending the activity data; a processor adapted to execute a tracking module to receive the activity data from the transmitter; and a memory in communication with the processor adapted to store the activity data.

The processor may be adapted for approximating caloric expenditure based at least in part on the activity data. According to an embodiment of the invention, caloric expenditure is approximated based at least in part on a user's basal metabolic rate.

BRIEF DESCRIPTION OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As described above, various embodiments of the present invention are directed to an apparatus for promoting exercise by a user comprising one or more sliding units for facilitating and sensing movement applied thereto by the user. According to various embodiments, the sliding unit generally includes at least a body member, a sensor, and a transmitter.

As described above, in one embodiment, the sensor is an accelerometer. In other embodiments, the sensor may be a pendulum or an optical detection device, such as an infrared sensor. Furthermore, more than one sensor may be utilized in order to detect two-dimensional or three-dimensional movement. Various embodiments of these sensors and their respective capabilities are described herein.

Sliding Unit

Figure 1:
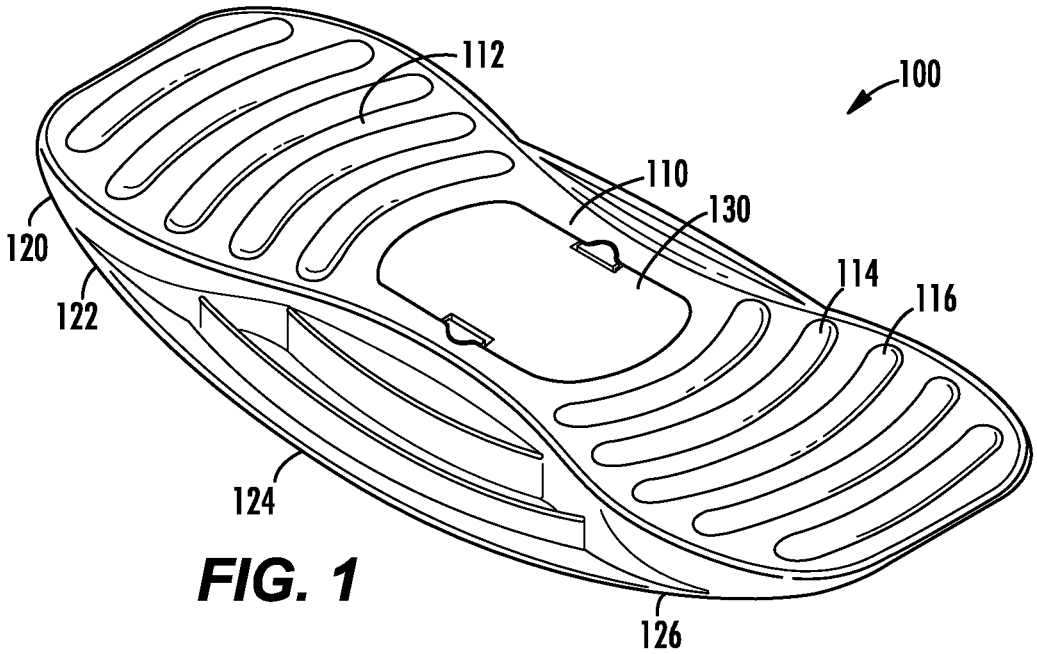
FIG. 1 shows a perspective view of a sliding unit according to one embodiment of the present invention.

As shown in FIG. 1, a sliding unit 100 according to one embodiment includes a body member comprising a platform 110 adapted to receive a shoe or a foot, a sliding surface 120, and an electronic component 130. The platform 110 can be generally planar and serves as the top surface of the sliding unit 100. In the present embodiment, the platform 110 has a front section 112 and a back section 114. Although "front" and "back" sections are described herein for clarity, the sections could be identical so that the sliding unit would function the same regardless of a front or back orientation. A plurality of gripping members 116 are adhered to the platform 110 in a radial-oriented pattern. The gripping members 116 may also be integrally formed from the surface of the platform 110. In addition, depending on the desired level of friction, the gripping members 116 may be formed from various types of materials, including rubber, plastic, or nylon, capable of creating traction with various types of shoes, bare feet and stocking feet, or may be eliminated entirely if there is sufficient grip with the platform.

Figure 2:
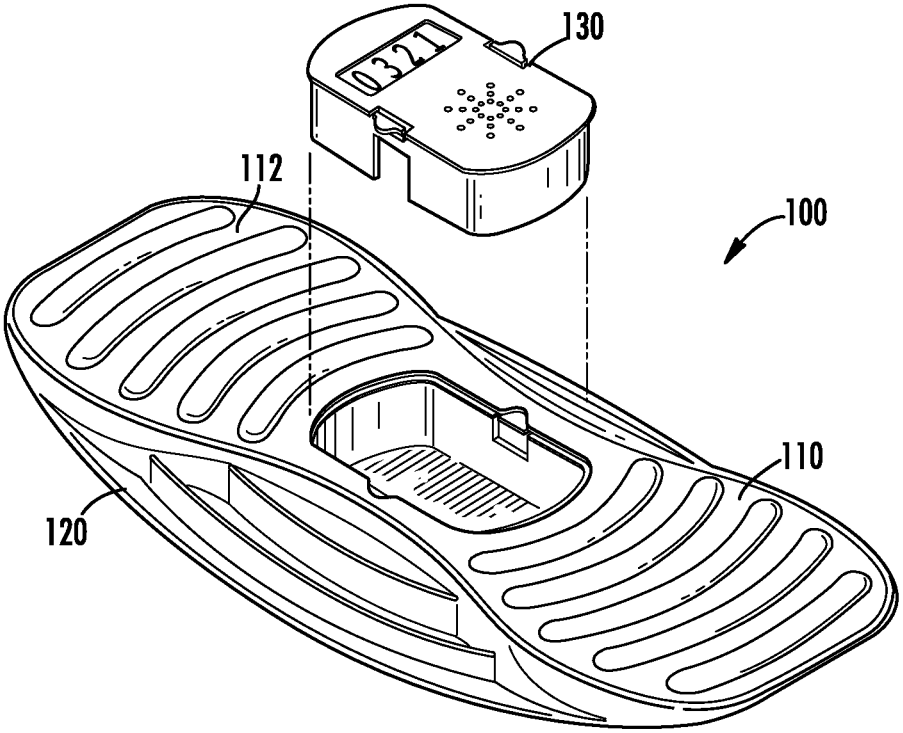
FIG. 2 shows an exploded perspective view of a sliding unit according to one embodiment of the present invention.

Situated within the platform 110, between the front section 112 and the back section 114, is an electronic component 130. As shown in FIG. 2, the electronic component 130 is removably attachable to the sliding unit 100, such as with a snap fit. In various embodiments, the electronic component 130 may be interchanged with other similarly shaped components capable of providing additional features. For example, as described in further detail below, various electronic components may include combinations of features such as other sensors, displays, speakers, and/or other indicators. In other embodiments, the electronic component may be housed within the sliding unit in a permanent manner.

As shown in FIG. 1, the sliding surface 120, which is below the platform 110, can form a curvature, which is described in further detail below with respect to FIGS. 3A and 3B, around the electronic component 130. The sliding surface 120 has a front section 122, a middle section 124, and a back section 126. The front section 122 is located directly underneath the front section 112 of the platform 110, and the back section 126 is located directly underneath the back section 114 of the platform 110. The middle section 124 is beneath the electronic component 130. In one embodiment, the sliding surface 120 is formed from ultra-high-molecular-weight polyethylene (UHMW-PE), which those skilled in the art recognize as having a relatively low coefficient of friction. The sliding surfaces in various other embodiments may be composed of other materials with low coefficients of friction such as Teflon® (e.g., polytetrafluoroethylene) or polypropylene. In embodiments of the invention, the sliding surface 120 has a coefficient of friction with a floor surface of less than about 0.5. Furthermore, the sliding surface is smooth, with little to no texture, and creates little or no noise in use. In some embodiments, the sliding surface is surfaced with a soft material such as a textile, including felt.

In various embodiments, one or more wheels or rollers may be integrated in the sliding surface for facilitating movement. In one example embodiment, rollers are provided in recesses in the sliding surface with their axles behind the sliding surface so that the sliding units appear similar to the illustrated units but the primary movement on a floor is by way of a rolling action.

As further shown in FIG. 3A, the sliding unit 100 is configured to rest on a support surface (e.g., a floor 50 below the user's desk) when not in use. For example, in one embodiment the sliding surface 120 is curved so that when the sliding unit 100 is placed on the floor 50 and has equal weight distribution applied thereon, only the middle portion 124 is in contact with the support surface. In various embodiments, the longitudinal curvature of the sliding surface 120 (i.e., from the front section 122 to the back section 126 along a longitudinal axis) may form a bottom radius in the range of approximately 8" to approximately 20", and in particular about 15". However, the bottom radius of curvature is not necessarily constant from front to back and may vary along the longitudinal axis.

In various embodiments, the sliding surface 120 also has a transverse axis defining a generally flat central portion and curved edges 132 defining an edge radius, as can be seen in FIGS. 13 to 16. The edge radius of the curved edges 132 is in some embodiments smaller than the bottom radius along the longitudinal axis, and may be between about ⅛" and about 8". The edge radius of curvature is not necessarily constant and may vary. According to an embodiment, the edge radius varies from ⅛" at the ends to 5/16" at the center. The curved edges may be formed on body member extensions 134 that provide a wider footprint for the sliding unit than the width of the top surface of the platform 110. The respective degrees of curvature and body member extensions 134 allow the sliding unit 100 to rock front-to-back while maintaining side-to-side stability.

Figure 3A:
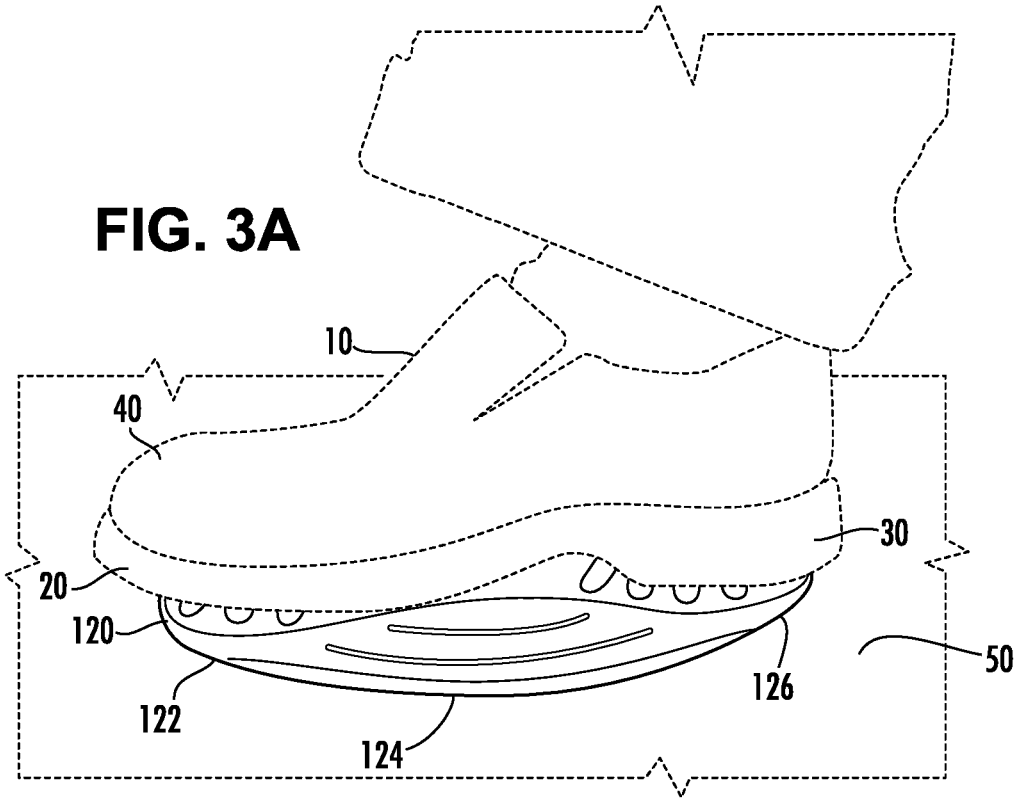
FIG. 3A shows a side perspective view of a sliding unit in a first position according to one embodiment of the present invention.
Figure 3B:
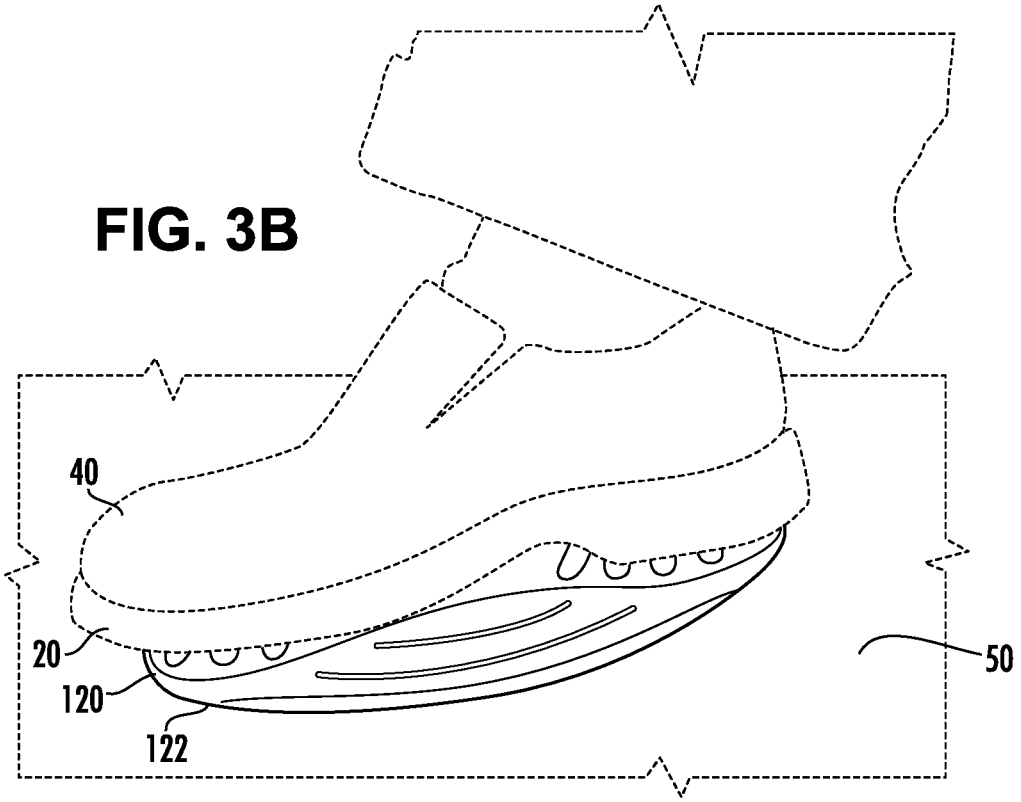
FIG. 3B shows a side perspective view of a sliding unit in a second position according to one embodiment of the present invention.

As further illustrated in FIGS. 3A and 3B, the sliding unit 100 is adapted to respond to the movement of a user's foot. In particular, the top surface of the platform 110 of the sliding unit 100 is adapted to receive a user's shoe 10, which in this embodiment has a generally flat sole 20 and generally flat heel 30. The gripping members 116 on the front section 112 of the platform 110 make contact with the sole 20, and the gripping members 116 on the back section 114 make contact with the heel 30. In the present embodiment, the front section 112 of the platform 110 is adapted to receive a generally flat heel 30. However, in other embodiments, the platform 110 may be adapted to receive an elevated heel. One such platform 110 includes a round gripping member 116 adapted to receive the bottom of an elevated heel.

In the present embodiment, the gripping members 116 are elevated slightly from the top surface 110 to ensure adequate contact with the sole 20 and the heel 30. In this way, the user's foot is positioned so that when it applies force on the platform 110 in certain directions through the sole 20 or the heel 30, it imparts a corresponding movement on the sliding unit 100. A longitudinal curvature of the sliding surface 120 in the range of between about 8" to about 20" facilitates ankle movement and lowers ankle stress while at the same maintaining the user's foot on the sliding unit 100. Due to the curvature of the sliding surface 120, application of an appropriate force against the front section 112, for example, through the toe 40 of the user's shoe, will cause the front section 122 to come in contact with the floor 50, as illustrated in FIG. 3B. Likewise, the appropriate force applied against the back section 114, for example, through the heel 30 of the user's shoe, would cause the back section 126 of the sliding surface 120 to contact the support surface.

Range of Movement

Figure 4:
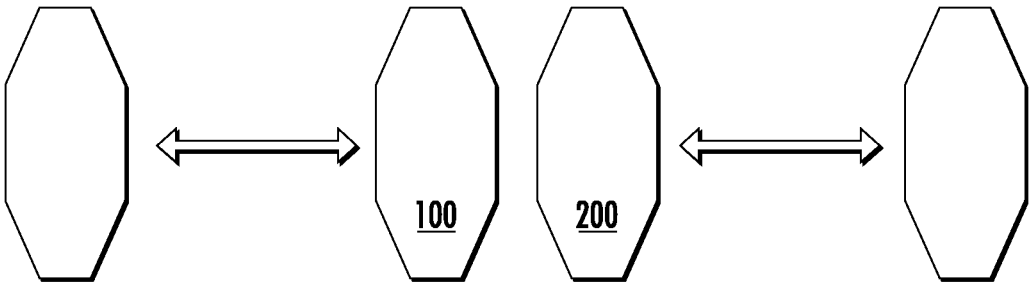
FIG. 4 shows a top view of a side-to-side movement pattern of a pair of sliding units according to one embodiment of the present invention.
Figure 5:
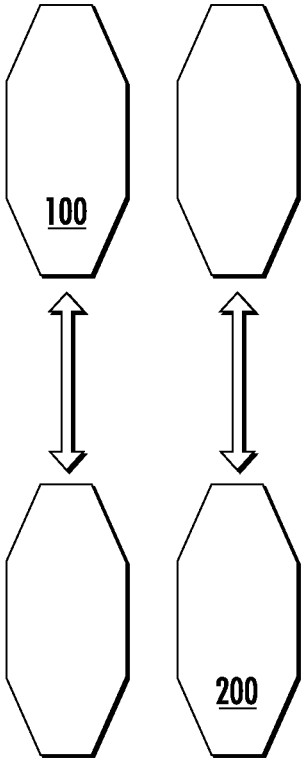
FIG. 5 shows a top view of a linear movement pattern of a pair of sliding units according to one embodiment of the present invention.
Figure 6:
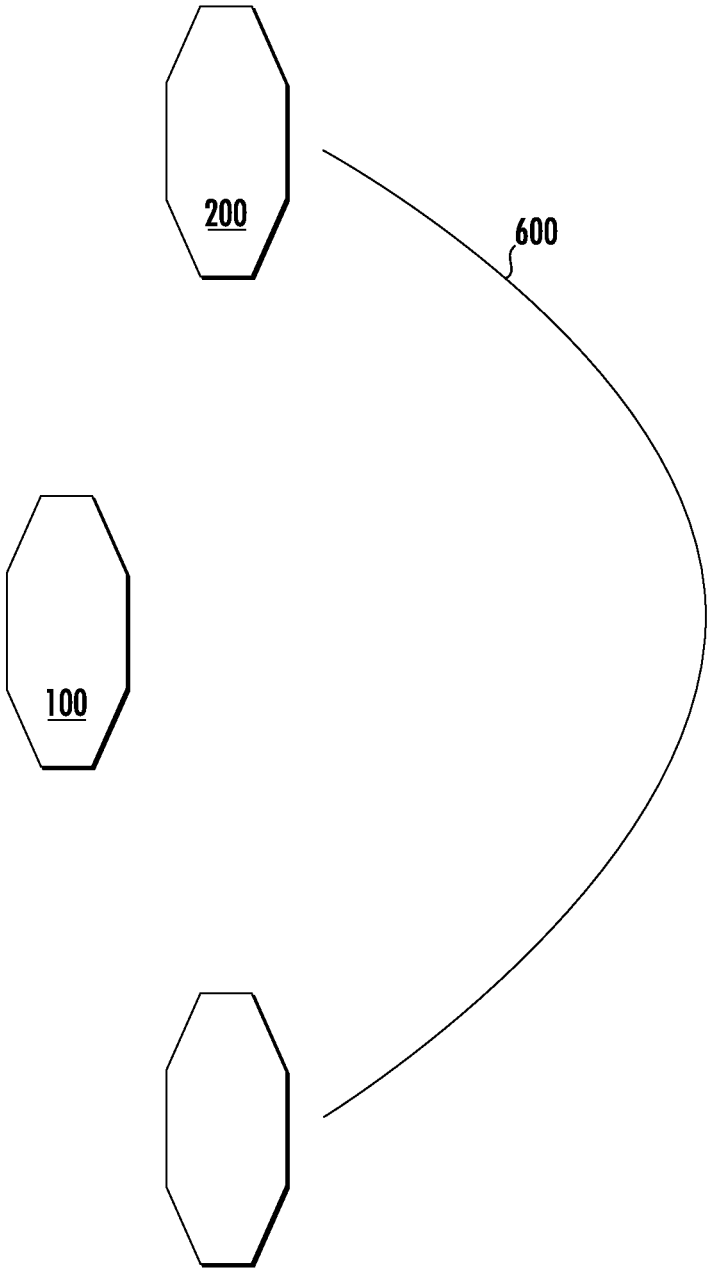
FIG. 6 shows a top view of an arcuate movement pattern of a sliding unit according to one embodiment of the present invention.

FIGS. 4 through 6 show movement patterns carried out by a pair of sliding units 100 and 200 according to one embodiment of the present invention, where sliding unit 100 is adapted for use by the user's left foot (not shown), and sliding unit 200 is adapted for use by the user's right foot (not shown). These movement patterns may be generated under the desk of a user seated on a chair or an exercise ball.

As illustrated in FIGS. 4 through 6, the sliding units 100 and 200 are capable of facilitating movement in a variety of directions. In FIG. 4, the sliding units 100 and 200 are initially in a side-by-side position. Due to the gripping connection (shown in FIGS. 3A and 3B) formed by the gripping members 116 between the sole and the heel of the user's shoe, the user's foot can effectuate movement of the sliding units 100 and 200.

The user moves each foot laterally, first outward and then inward, back to the initial side-to-side position. The movement can be repeated in this fashion. In this movement pattern, as well as the movement patterns shown in FIGS. 5 and 6, the sliding units 100 and 200 can move either independently or simultaneously. Furthermore, when moving simultaneously, the sliding units 100 and 200 may mirror each other in movement. Alternatively, the sliding units 100 and 200 may move in parallel with each other.

FIG. 5 illustrates a front-to-back movement, wherein sliding unit 100 is initially in a rearward position, and sliding unit 200 is initially in a forward position. Sliding unit 100 then moves along a linear path to the forward position and back to the rearward position. Sliding unit 200 moves along a parallel linear path to the rearward position and back to the forward position. In FIG. 6, sliding units 100 and 200 begin at the same respective positions as in FIG. 5. However, in the movement pattern illustrated in FIG. 6, sliding unit 200 forms an arc 600 around sliding unit 100.

In other embodiments, the sliding units 100 and 200 can be adapted for facilitating various other types of movements.

Electronic Component

Figure 7:
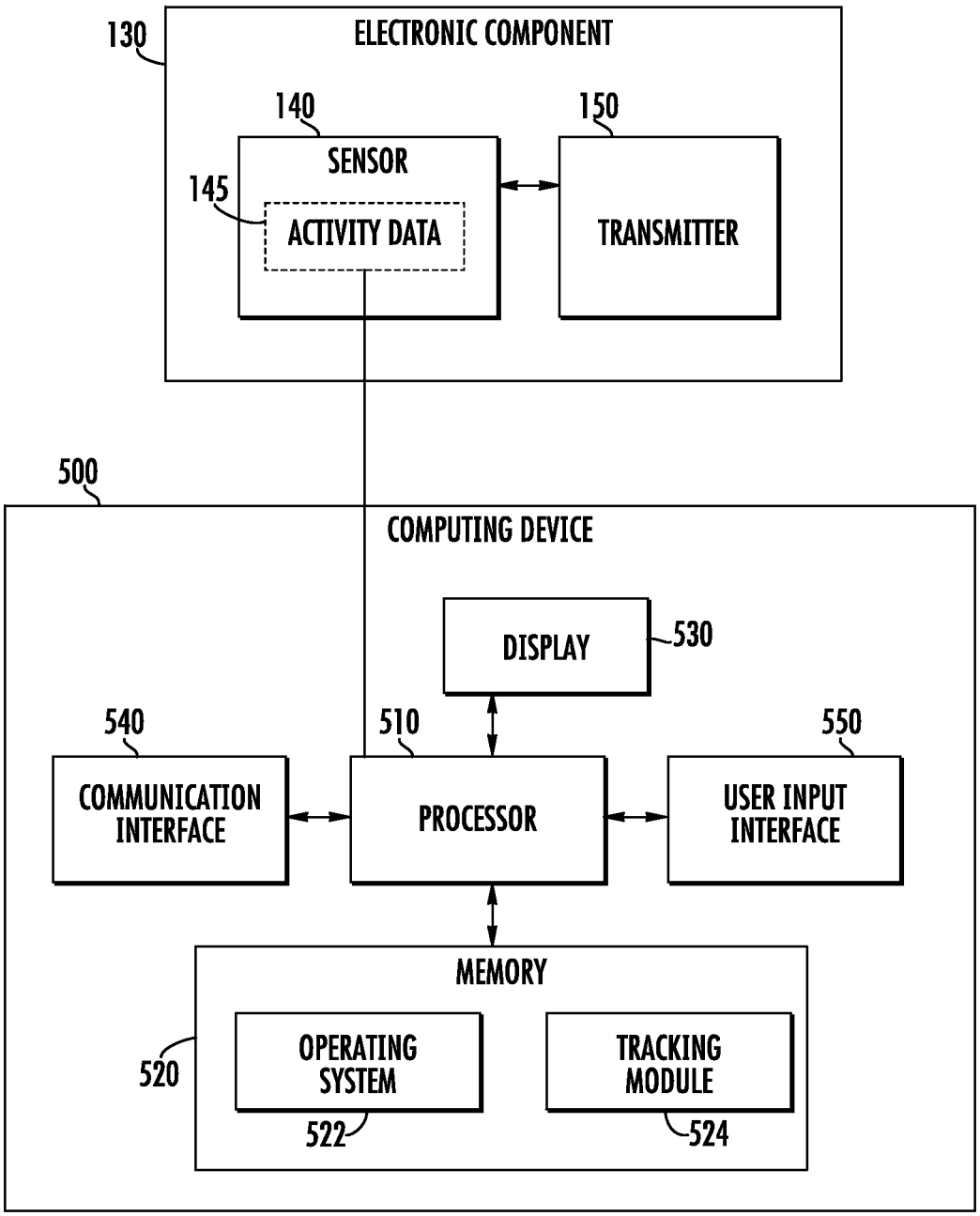
FIG. 7 shows a schematic view of the electronic unit and the computer device of the exercise system according to one embodiment of the present invention.

In the illustrated embodiment of FIG. 7, the electronic component 130 comprises a sensor 140, a transmitter 150, and a power supply (not shown). The power supply in various embodiments may be a rechargeable removable battery or other battery source. The power supply may be controlled by a manual ON/OFF switch or an automatic wake-up component.

The sensor 140 is adapted to detect motion of the sliding unit 100 and generate activity data 145 indicative of one or more characteristics of this motion. For example, the sensor 140 may be an accelerometer capable of detecting motion along two axes so that the resulting activity data 145 has at least two components such as, for example, the two-dimensional position relative to the plane of a floor. In various embodiments, the sensor 140 may be capable of detecting motion along three axes so that the resulting activity data 145 has at least three components such as for, example, the tilt angle of the sliding unit in addition to the two-dimensional position relative to the floor. For example, the sensor in one embodiment is a three-axis accelerometer capable of generating a signal showing intensity and duration of a detected motion. According to another embodiment, the sensor 140 may be comprised of multiple sensors configured to indicate the position, velocity, and/or direction of the sliding unit 100 at one or more points along the movement path. In other embodiments, the sensor may be a laser device.

The transmitter 150 is capable of establishing a communication session with a computing device 500. In addition, the transmitter 150 of the present embodiment may perform functions of both a transmitter and a receiver. The transmitter 150 may include, for example, a universal serial bus (USB) port for communications over a cable, a Bluetooth wireless interface for communicating with other Bluetooth devices, or a wireless network interface (WiFi) card for wireless communications. In particular, the transmitter 150 in the present embodiment is adapted to access and send the activity data 145 from the sensor 140 to the computing device 500.

The computing device 500 in the present embodiment comprises a processor 510, a memory 520, a display 530, a communication interface 540, and a user input interface 550. In various embodiments, the computing device 500 can be any workstation, desktop computer, laptop or notebook computer, server, handheld computer, mobile telephone or other portable telecommunication device, media playing device, gaming system, mobile computing device, or any other type and/or form of computing, telecommunications or media device capable of performing the operations described herein and can be located in any proximate or remote location including the user's desk, in or on the sliding unit 100 itself, or at a location centralized for a collection of users such as coworkers. The processor 510 in the present embodiment is configured to communicate with memory 520, display 530, communication interface 540, and user input interface 550.

Memory 520 may include a random access memory (RAM) or another type of dynamic or static storage device that may store information and instructions for execution by processing logic, a read-only memory (ROM) device or another type of static storage device, a persistent memory such as flash memory, and/or some other type of magnetic or optical recording medium and its corresponding drive, e.g., a hard disk drive (HDD), for storing information and/or instructions.

In the present embodiment, memory 520 further comprises an operating system 522 and a tracking module 524. Memory 520 may include other components (not shown) that aid in receiving, transmitting, and/or processing data.

Moreover, other configurations of components in memory 520 are possible. In one embodiment, the memory 520 may record an interval of time since the last use of the exercise apparatus, even if the power supply is turned off, and the operating system is configured to provide an indicator or alarm that it is time for the user to exercise again. Such an indicator or alarm maybe provided on the display 530 and/or speaker on the sliding unit 100 and/or on a user's separate computer.

In the present embodiment, operating system 522 provides a software platform for carrying out various applications associated with the activity data 145. For example, operating system 522 may be any version of Microsoft Windows, Unix, Linux, Mac OS, any embedded operating system, any real-time operating system, any open source operating system, any proprietary operating system, any operating systems for mobile computing devices, or any other operating system capable of running on the computing device and performing the operations described herein. The operating system 522 in various embodiments may be configured to interact with an application program interface (API).

Tracking module 524 processes activity data 145 received from the electronic component 130 to perform a variety of functions. For example, tracking module 524 may be configured to store a log of activity data 145 generated by the sensor 140 in a data table (not shown). Tracking module 524 may access this log of activity data 145 to generate charts showing activity history. In addition, tracking module 524 may manipulate the activity data 145 to provide additional types of information, such as number of movements, calories burned, and progress toward various pre-set goals.

Figure 8:
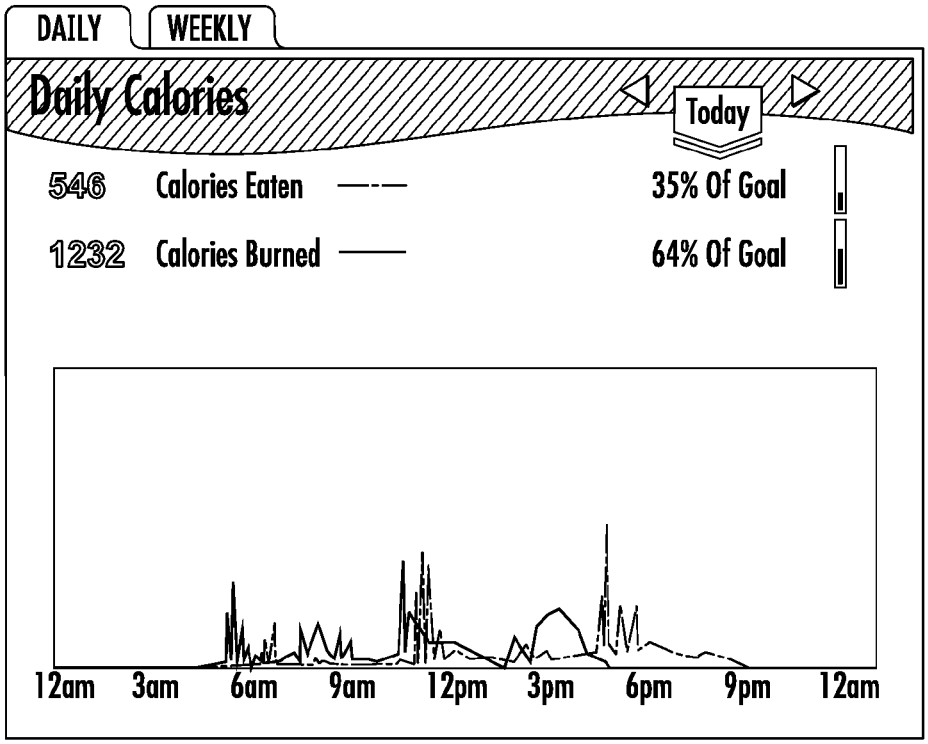
FIG. 8 shows a schematic view of an activity tracking interface according to one embodiment of the present invention.

In various embodiments, the sliding unit of the present invention can be used with calorie tracking applications known in the art (e.g., Fitbit Tracker and associated analysis software, distributed by Fitbit, Inc. of San Francisco, Calif.). For example, as shown in FIG. 8, tracking module 524 in the present embodiment is configured to output calorie tracking data, including calories burned and associated progress toward a pre-set goal. In the embodiment displayed in FIG. 8, the user has preset a goal of burning 2,184 calories using the sliding unit on the indicated day. The user may be presented with a variety of factors to consider in determining this goal, such as the user's current weight, the user's goal weight, and desired intensity of sliding movements. In various embodiments, the user's basal metabolic rate may also be considered as a factor in determining a daily goal. Furthermore, FIG. 8 shows the option of tracking "calories eaten" by the user. In this embodiment, the user may input an estimate of calories eaten throughout the day, to plot against calorie burn, in order to estimate the user's net calories for the day.

There are various approaches in the art for estimating caloric expenditure based on physical activity. Several of these approaches are detailed in Staudenmayer, J., Prober, D., Crouter, S., Bassett, D., Freedson, P., "An artificial neural network to estimate physical activity energy expenditure and identify physical activity type from an accelerometer," *J Appl Physiol,* 107: 1300-1307 (2009) and van Hees, V. T. and Ekelund, U., "Novel daily energy expenditure estimation by using objective activity type classification: where do we go from here?" *J Appl Physiol* 107: 639-640 (2009), the entireties of which are herein incorporated by reference). These calorie tracking applications use tools, such as logs, analytics, and social networks, to generate and share fitness and health-related data.

In addition, in various other embodiments not illustrated herein, tracking module 524 may also generate charts showing movement patterns of the sliding units. These charts can be compared to suggested movement patterns to provide a user with feedback regarding accuracy of movement. The charts may indicate intensity and speed of movement using, for example, variations in colors or line grade.

In other embodiments, tracking module 524 may be configured to provide the user with interactive physical therapy functions. For example, in the case of a user with a physical condition requiring recuperative activity, tracking module 524 may contain or access a physical therapy plan incorporating the predetermined movements of the sliding unit based on the user's particular condition. Tracking module 524 may communicate with the electronic component 130 in order to instruct the user on the steps recommended by the physical therapy plan (i.e., through feedback mechanisms on the electronic component 130 described above). Tracking module 524 may also receive data from the electronic component 130 in order to track the user's progress in relation to the physical therapy plan. In addition, using this data, tracking module may provide certain analyses or even transmit information regarding the user's progress to a physical therapist or other health professional.

In one embodiment, the sensor 524 is configured to limit the range of motion for the sliding unit for physical therapy patients. For example, patients rehabilitating from knee surgery may be required to flex the knee joint but also limit the range of motion of the knee through a certain angular interval measured from front to back. Similarly, hip surgery patients may be required the move the hip from side to side through a prescribed angular interval. The tracking module 524 tracks the movement of the sliding units and can provide an alarm when the sliding units exceed the prescribed angular ranges. According to one embodiment, the sensor 140 is configured to activate an alarm on the sliding unit when the prescribed angular range is exceeded without transmitting the activity data to a separate tracking module 524.

Figure 9:
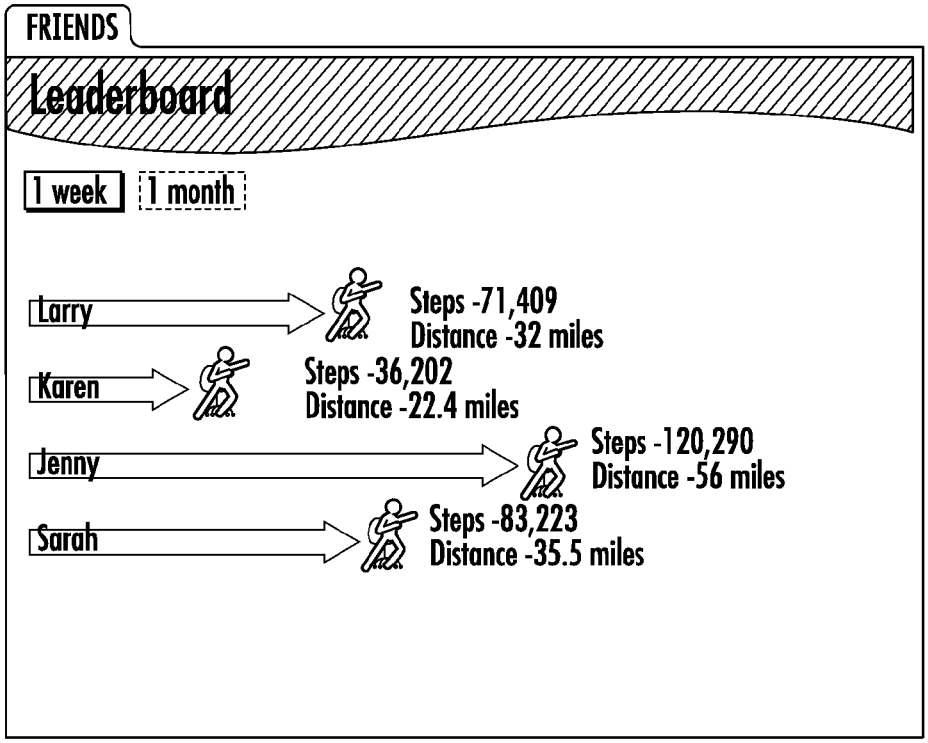
FIG. 9 shows a schematic view of a social networking interface according to one embodiment of the present invention.

In various embodiments, memory 520 may further comprise a social networking component (not shown). For example, the social networking component may be configured to access a network for communicating with other users. In various embodiments, the activity data 145 may be sent to a social networking server. As shown in FIG. 9, a plurality of users can each share their total number of steps and miles traveled for a seven day period, as well as the respective daily averages of each. Furthermore, in the illustrated embodiment, each user's total steps are converted to points, which add a competitive aspect to the social networking component. In addition, the social networking component can track the number of minutes a user has been "very active," which in some embodiments can be determined based on the intensity of a user's movements or the number of movements in a given time period.

Another feature in various embodiments is incorporation with insurance provider programs. For example, certain insurance providers have incentive programs (e.g., Blue Cross Blue Shield Blue Points$^{SM}$) that allow participants to track health and wellness activities and provide rewards for reaching certain activity levels. In this way, tracking module 524 in certain embodiments can be configured to process and send activity data 145 to a given insurance provider network for incentive tracking.

Display 530 may be a device such as a monitor that outputs information from the processor 510 to the user. Communication interface 540 may include any transceiverlike mechanism that enables computing device 500 to communicate with the transmitter 150 in the electronic component 130. Communication interface 540 may include a transmitter that may perform functions of both a transmitter and a receiver. Communication interface 540 may include, for example, a universal serial bus (USB) port for communications over a cable, a Bluetooth® wireless interface for communicating with other Bluetooth® devices, an ANT+ interface or a wireless network interface (WiFi) card for wireless communications.

User input interface 550 may include one or more devices that permit a user to input information into processor 510, such as a keyboard, keypad, a mouse, a pen, a microphone, a remote control, a touch-screen display, one or more biometric mechanisms, or the like. In various embodiments, one user input interface device may be a heart-monitoring component that is capable of generating and transmitting data indicative of one or more characteristics of a user's heart beat patterns. In these embodiments, memory 520 may further comprise an application configured to access this data to provide customized feedback to the user.

Spring-Loaded Non-Slip Surface

Figure 10:
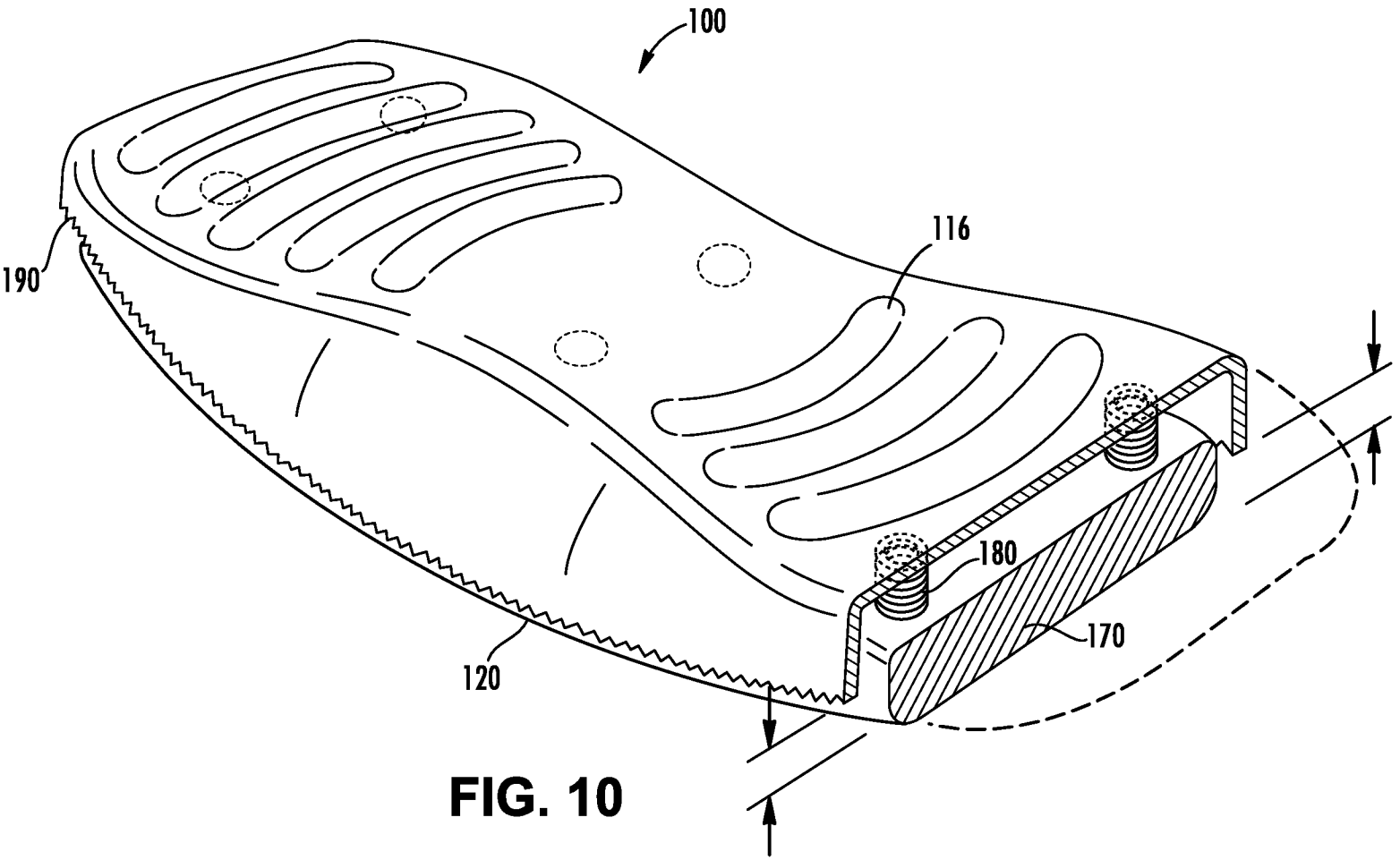
FIG. 10 shows a perspective view of a sliding unit having a non-slip surface according to an embodiment of the present invention.

FIG. 10 illustrates an embodiment of the present invention wherein the sliding unit 100 features a non-slip feature comprising a set of springs 180 and a non-slip surface 190, which may be formed integrally with the platform 110. In this embodiment, the sliding surface 120 forms the bottom surface of a body member 170. Situated between the opposite surface of the body member 170 and a top surface of the platform 110 is the set of springs 180. When at least a threshold force is applied to the platform 110, the springs 180 will compress, causing the non-slip surface 190 to extend past the sliding surface 120.

The threshold force in various embodiments may be determined based at least in part on average user weight. For instance, the springs 180 may be calibrated to compress substantially in response to the weight of a user but also to resist compression when the user is operating the sliding unit 100 while seated. When the user enters a standing position, the springs 180 will substantially or fully compress, causing the non-slip surface 190 to extend past the sliding surface 120 and make contact with the ground surface. In the present embodiment, the non-slip surface 190 is jagged so that it creates traction on, for instance, a carpeted surface. However, in various other embodiments, the non-slip surface may be composed of rubber material to create traction on hard surfaces. This feature will therefore prevent the sliding units from sliding out from under the user if, for instance, the user moves from the seated to the standing position.

Removable Covering

Figure 11:
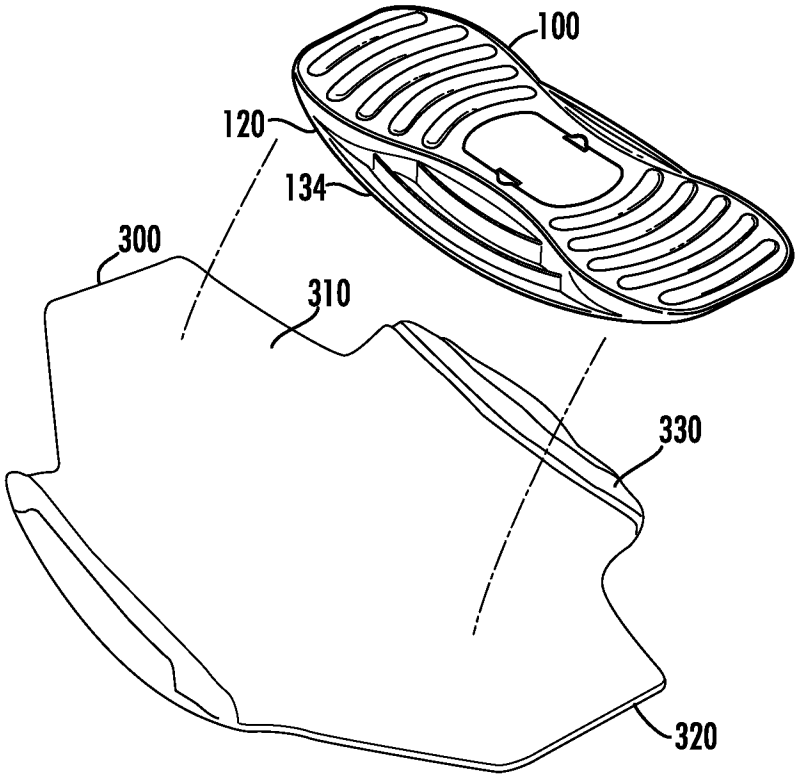
FIG. 11 shows an exploded perspective view of a sliding unit with a snap-on cover according to an embodiment of the present invention.
Figure 14:
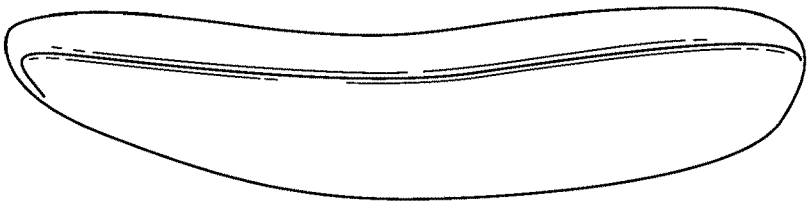
FIG. 14 shows a bottom perspective view of a sliding unit according to an embodiment of the present invention.
Figure 16:
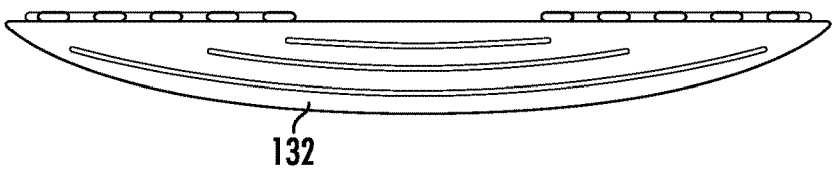
FIG. 16 shows a side view of a sliding unit according to an embodiment of the present invention.
Figure 13:
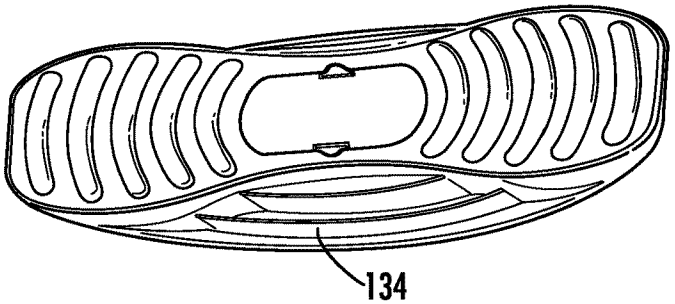
FIG. 13 shows a top perspective view of a sliding unit according to an embodiment of the present invention.
Figure 15:
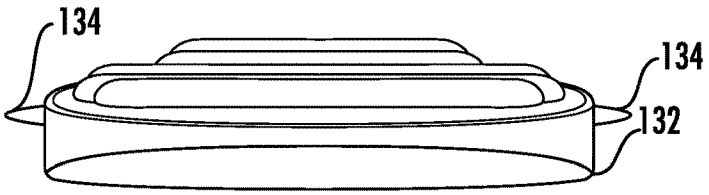
FIG. 15 shows a front side view of a sliding unit according to an embodiment of the present invention.

FIG. 11 illustrates an embodiment of the sliding unit 100 featuring a removable cover 300. The removable cover 300 is comprised of a rigid body 310 and a soft fabric underside 320, which, in the present embodiment, is attached to the rigid body 310 with adhesive. The rigid body 310 is shaped to align with and cover the curved sliding surface 120 of the sliding unit 100. Each side of the rigid body has a flap 330 adapted for removable snapping attachment onto the body member, such as over the body member extensions 134 on each side of the sliding unit 100.

Figure 12:
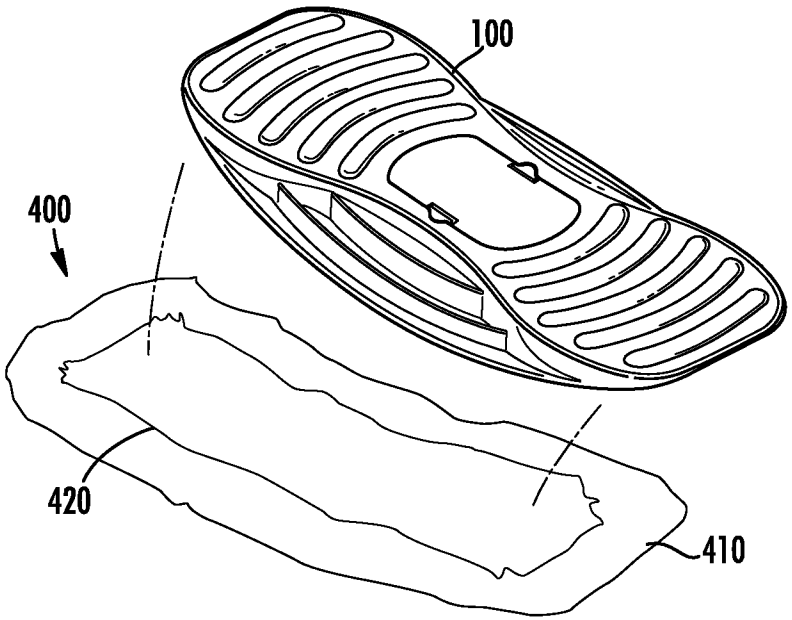
FIG. 12 shows an exploded perspective view of a sliding unit with a slip-on cover according to another embodiment of the present invention.

FIG. 12 illustrates an embodiment of the sliding unit 100 featuring another removable cover 400. The removable cover 400 in the present embodiment is comprised of a fabric sock 410 and an adjustable retaining ring 420. The adjustable retaining ring 420 is adapted to fit around, and securely hold the fabric sock 410 over, the sliding surface 120. In various embodiments, the adjustable retaining ring 420 may be an elastic band.

When attached to the sliding unit 100, each of the removable covers 300 and 400 forms a protective layer between the sliding surface 120 and delicate ground surfaces, such as a hardwood floor. In this way, the removable covers 300 and 400 reduce friction and noise between the sliding surface 120 and ground surface and protect against damage to the surface.

Other Views and Embodiments

Various other embodiments of an exercise system incorporating the sliding units described herein may be used to facilitate and sense movements of a user. For example, the components of the sliding unit described above may be modified to accommodate a hand or a leg, as opposed to a foot. In addition, it is contemplated that the embodiments of the sliding unit may be modified to accommodate various exercise techniques and types of motions. Furthermore, as will also be appreciated by one of skill in the art, the general principles of the leg exercise apparatus described above may be incorporated into various other movement-sensing apparatuses. In addition, the computing device may be modified to accommodate various exercise tracking or physical therapy applications.

CONCLUSION

Many modifications and other embodiments of the present invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for promoting exercise by a user while seated comprising:

one or more sliding units configured to facilitate and sense a movement applied thereto by the user, wherein each of the sliding units has a defined length and comprises:

a body member comprising:

a top surface lying in a first plane and extending along a longitudinal axis of said body member, the top surface configured for receiving a foot of the user; and a rotationally fixed sliding bottom surface extending along the longitudinal axis of said body member and configured for sliding movement in at least one direction relative to and in contact with a floor surface, said sliding bottom surface having a defined length at least equal to the defined length of the at least one of the sliding units and a constant degree of curvature extending along an entirety of the defined length of the sliding bottom surface extending along the longitudinal axis of the body member, wherein at least one portion of the sliding bottom surface is lying in a second plane spaced apart from and parallel with the first plane;

at least one body member extension, extending laterally from a side of the body member and configured for providing a wider footprint of the body member than a footprint provided by the top surface of the body member, said at least one body member extension having a degree of curvature extending along a transverse axis of the body member, the transverse axis being substantially perpendicular to and coplanar with the longitudinal axis, wherein the at least one body member extension is lying in a third plane parallel with both the first and second planes, the third plane being intermediate the first and second planes such that the at least one body member extension is positioned intermediate the top surface and the at least one portion of the sliding bottom surface; and a sensor configured for sensing and generating data representative of one or more characteristics of the sliding movement.

2. An apparatus according to claim 1, wherein the tom surface is a platform adapted to removably receive a shoe.

3. An apparatus according to claim 2, wherein the at least one body member extension comprises two body member extensions configured to provide a wider footprint for the sliding unit than a width of the top surface.

4. An apparatus according to claim 2, wherein the platform further comprises a set of gripping members capable of providing traction against the shoe.

5. An apparatus according to claim 1, wherein the sensor is an accelerometer.

6. An apparatus according to claim 5, wherein the accelerometer is a three-axis accelerometer.

7. An apparatus according to claim 1, further comprising a transmitter adapted for receiving the data from the sensor and transmitting the data to a computing device.

8. An apparatus according to claim 7, wherein the transmitter is a wireless transmitter.

9. An apparatus according to claim 1, wherein the sensor is built into a technology pack capable of being removably attached to the body member.

10. An apparatus according to claim 9, wherein the technology pack further comprises at least one of a rechargeable battery, a display, an audible indicator, and a visual indicator.

11. An apparatus according to claim 1, wherein the one or more sliding units comprises a first sliding unit and a second sliding unit, wherein the first sliding unit is adapted for a left foot and the second sliding unit is adapted for a right foot.

12. An apparatus according to claim 1, further comprising at least one of a display, an audible indicator, and a visual indicator adapted to provide feedback to the user.

13. An apparatus according to claim 1, further comprising a removable cover over the sliding surface and having a soft underside.

14. An apparatus for promoting exercise by a user while seated, the apparatus comprising:

one or more sliding units configured to facilitate movement applied by the user, wherein at least one of the sliding units comprises:

a body member configured to receive a foot of the user, the body member having a top surface and a sliding bottom surface, said top surface lying in a first plane, having a width, and providing a gripping surface, said bottom surface comprising a low-friction material, said body member configured for sliding movement in at least one direction and in contact with a floor surface, wherein:

said bottom surface has a bottom radius on a longitudinal axis of the body member, said bottom radius having a constant degree of curvature extending along an entirety of a length of the bottom surface defined along the longitudinal axis of the body member, at least one portion of the bottom surface lying in a second plane spaced apart from and parallel with the first plane, and said bottom surface has a smaller edge radius on a transverse axis of the body member, the transverse axis being substantially perpendicular to and coplanar with the longitudinal axis, and at least one body member extension, extending laterally from a side of the body member and having a degree of curvature extending along the transverse axis, wherein the at least one body member extension defines a footprint of the body member, the footprint being wider than the width of said top surface of the at least one of the sliding units, the at least one body member extension lying in a third plane parallel with both the first and second planes, the third plane being intermediate the first and second planes such that the at least one body member extension is positioned intermediate the top surface and the bottom surface.

15. An apparatus according to claim 14, further comprising at least one of a display, an audible indicator, and a visual indicator adapted to provide feedback to the user.

16. An apparatus according to claim 14, wherein the gripping surface is capable of providing traction against a shoe sole.

17. An apparatus according to claim 14, wherein the bottom radius is between about 8" and about 20".

18. An apparatus according to claim 14, wherein the edge radius is about between about ⅛" and about 8".

19. An apparatus for promoting exercise by a user while seated comprising:

one or more sliding units configured to facilitate movement applied by the user, wherein at least one of the sliding units comprises:

a body member configured to receive a foot of the user, the body member having a top surface and a sliding bottom surface, said top surface lying in a first plane, having a width, and providing a gripping surface, said bottom surface comprising a low-friction material and being configured for sliding movement in at least one direction and in contact with a floor surface, wherein:

said bottom surface has a bottom radius on a longitudinal axis of the body member, the bottom radius having a constant degree of curvature extending along an entirety of a length of the bottom surface defined along the longitudinal axis of the body member, at least one portion of the bottom surface lying in a second plane spaced apart from and parallel with the first plane, and said bottom surface has a smaller edge radius on a transverse axis of the body member, the transverse axis being substantially perpendicular to and coplanar with the longitudinal axis, at least one body member extension having a degree of curvature extending along the transverse axis, wherein the at least one body member extension defines a footprint of the body member, the footprint being wider than the width of said top surface of the at least one of the sliding unit, the at least one body member extension lying in a third plane parallel with both the first and second planes, the third plane being intermediate the first and second planes such that the at least one body member extension is positioned intermediate the top surface and the bottom surface; and a sensor configured for sensing and generating data representative of one or more characteristics of the sliding movement.

20. An apparatus according to claim 19, wherein the sensor is an accelerometer.

21. An apparatus according to claim 20, wherein the accelerometer is a three-axis accelerometer.

22. An apparatus according to claim 19, further comprising at least one of a display, a speaker, and an indicator adapted to provide feedback to the user.

23. An apparatus according to claim 19, wherein the bottom radius is between about 8" and about 20".

24. An apparatus according to claim 19, wherein the edge radius is about between about ⅛" and about 8".

25. A system for promoting exercise, said system comprising:

one or more sliding units configured to facilitate and sense movement applied thereto by the user, at least one of said sliding units having a defined length and comprising:

a body member configured to receive a foot of the user and comprising:

a top surface lying in a first plane, the top surface configured to receive the foot of the user;

a rotationally fixed sliding surface configured for sliding movement in at least one direction relative to and in contact with a floor surface, said rotationally fixed sliding surface having a defined length at least equal to the defined length of the at least one of said sliding units and a constant degree of curvature extending along an entirety of the defined length of the sliding surface extending along the longitudinal axis of the body member;

at least one body member extension, extending laterally from a side of the body member and configured for providing a footprint of the body member wider than a footprint provided by the top surface, the at least one body member extension lying in a second plane spaced below and parallel with the first plane, such that the at least one body member extension is positioned intermediate the top surface and the floor surface in contact with the rotationally fixed sliding surface;

a sensor configured for sensing movement and generating activity data representative of one or more characteristics of the sliding movement of the sliding unit of the surface of the body member in contact with and relative to the floor surface;

a transmitter configured for receiving and sending the activity data;

a processor configured to execute a tracking module to receive the activity data from the transmitter; and a memory in communication with the processor configured to store the activity data.

26. A system according to claim 25, further comprising an application program interface.

27. A system according to claim 26, wherein the processor is further adapted for approximating caloric expenditure based at least in part on the activity data.

28. A system according to claim 27, wherein caloric expenditure is approximated based at least in part on a user's basal metabolic rate.

29. A system according to claim 26, wherein the application program interface is adapted to interact with a third party activity incentive program.

30. A system according to claim 25, further comprising a rechargeable power source for the sensor and the transmitter.

31. A system according to claim 30, wherein the rechargeable power source is a rechargeable battery.

32. A system according to claim 25, wherein the transmitter is a wireless transmitter.

33. A system according to claim 25, wherein the processor is located at least partially within the at least one of the sliding units.

34. A system according to claim 25, wherein the memory is located at least partially within the at least one of the sliding units.

* * * * *